US012385144B1

(12) United States Patent
Zeng et al.

(10) Patent No.: US 12,385,144 B1
(45) Date of Patent: Aug. 12, 2025

(54) ANTI-CORROSION WEAR-RESISTANT DRILL PIPE AND PREPARATION METHOD THEREOF

(71) Applicant: SOUTHWEST PETROLEUM UNIVERSITY, Sichuan (CN)

(72) Inventors: Dezhi Zeng, Sichuan (CN); Chengxiu Yu, Sichuan (CN); Jiancheng Luo, Sichuan (CN); Qinying Wang, Sichuan (CN); Hanwen Zhang, Sichuan (CN); Yuchen Xi, Sichuan (CN); Guangguang Xiang, Sichuan (CN); Ruikang Ke, Sichuan (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 0 days.

(21) Appl. No.: 19/051,848

(22) Filed: Feb. 12, 2025

(30) Foreign Application Priority Data

Aug. 30, 2024 (CN) ..... 202411203957.6

(51) Int. Cl.
*C23F 13/00* (2006.01)
*C22C 38/02* (2006.01)
(Continued)

(52) U.S. Cl.
CPC ..... *C23F 13/005* (2013.01); *C22C 38/02* (2013.01); *C22C 38/44* (2013.01); *C22C 38/50* (2013.01); *C22C 38/54* (2013.01); *E21B 17/1085* (2013.01)

(58) Field of Classification Search
CPC ..... C23F 13/005; C22C 38/02; C22C 38/44; C22C 38/50; C22C 38/34; E21B 17/1085
See application file for complete search history.

(56) References Cited

U.S. PATENT DOCUMENTS 2,751,194 A * 6/1956 Rohrback ..... E21B 41/02 166/243
3,734,181 A * 5/1973 Shaffer ..... E21B 41/02 166/65.1
(Continued)

FOREIGN PATENT DOCUMENTS

CN 103781988 A 5/2014
CN 104328441 A 2/2015
(Continued)

OTHER PUBLICATIONS

Notification to Grant Patent Right for Invention, Chinese Application No. 202411203957.6, mailed Oct. 24, 2024 (3 pages).
(Continued)

*Primary Examiner* — Taras P Bemko
(74) *Attorney, Agent, or Firm* — HOWARD M COHN and Associates, LLC

(57) ABSTRACT

An anti-corrosion wear-resistant drill pipe and a preparation method thereof are provided. The anti-corrosion wear-resistant drill pipe includes a drill pipe main body, sacrificial anodes and wear-resistant belts. The sacrificial anodes include a first sacrificial anode, a second sacrificial anode, a third sacrificial anode and a fourth sacrificial anode, which have an open-circuit potential of −1.31 to −1.10 V, an operating potential of −1.21 to −0.98 V and a current efficiency of greater than 80% in a drilling fluid corrosive environment with a density of 1.2-2.5 g/cm$^3$, a chloride ion content of 1,200-180,000 mg/L, and a temperature of 30-120° C. The wear-resistant belts include a first wear-resistant belt, a second wear-resistant belt and a third wear-resistant belt, each having a surface hardness of greater than 750 $HV_{0.1}$.

13 Claims, 2 Drawing Sheets

(51) Int. Cl.

| | |
|---|---|
| ***C22C 38/44*** | (2006.01) |
| ***C22C 38/50*** | (2006.01) |
| ***C22C 38/54*** | (2006.01) |
| ***E21B 17/10*** | (2006.01) |

(56) References Cited

U.S. PATENT DOCUMENTS

| | | | | |
|---|---|---|---|---|
| 4,877,354 | A * | 10/1989 | Williamson | C23F 13/02 204/196.15 |
| 5,547,020 | A | 8/1996 | Sable et al. | |

FOREIGN PATENT DOCUMENTS

| | | | |
|---|---|---|---|
| CN | 204138770 | U | 2/2015 |
| CN | 206554818 | U | 10/2017 |
| CN | 207879277 | U | 9/2018 |
| CN | 109778174 | A | 5/2019 |
| CN | 210714510 | U | 6/2020 |
| CN | 112539037 | A | 3/2021 |
| CN | 115418645 | A | 12/2022 |
| CN | 116275132 | A | 6/2023 |
| CN | 117779016 | A | 3/2024 |
| JP | 2003034886 | A | 2/2003 |
| WO | 2022134573 | A1 | 6/2022 |

OTHER PUBLICATIONS

CNIPA, Office Action issued for Chinese Application No. 202411203957.6, mailed Oct. 11, 2024 (7 pages).

Huiguang Chen et al,"Application of Sacrificial Anode Anti corrosion and Anti eccentric Wear Technology in Wenliu Oilfield", Inner Mongolia, vol. 30, mailed Aug. 25, 2004.

Abioye TE, "Laser cladding of Inconel 625 wire for corrosion protection", Journal of Materials Processing Technology, Elsevier, NL vol. 217, pp. 232-240, mailed Nov. 4, 2014.

Jiangda Zhu et al, "Wear mechanism and experimental study of sucker rod/tubing", Joumal of Southwest Petrleum University, vol. 29, mailed Nov. 15, 2007.

* cited by examiner

ANTI-CORROSION WEAR-RESISTANT DRILL PIPE AND PREPARATION METHOD THEREOF

CROSS REFERENCE TO RELATED APPLICATIONS

The present disclosure claims the priority to the Chinese patent application with the application No. 202411203957.6, entitled "ANTI-CORROSION WEAR-RESISTANT DRILL PIPE AND PREPARATION METHOD THEREOF" and filed on Aug. 30, 2024 with the Chinese Patent Office, the contents of which are incorporated in the present disclosure by reference in their entirety.

TECHNICAL FIELD

The present disclosure belongs to the technical field of oil and natural gas engineering drilling, in particular to an anti-corrosion wear-resistant drill pipe and a preparation method thereof.

BACKGROUND ART

A drill pipe, an indispensable and important tool in a drilling process of oil and natural gas, has functions including transmitting torque, bearing tensile pressure, transporting a drilling fluid and others. With the rapid increase in demand for oil and natural gas for national economic development, oil and natural gas exploitation is facing a more complex exploitation environment. For example, the water content in a later stage of oil well exploitation increases greatly, and the development of a deep well leads to an increase in temperature and pressure. Moreover, in an actual drilling process, the drill pipe is easy to contact with an inner wall of the wellbore to produce friction. Therefore, higher requirements are put forward for the anti-corrosion wear-resistant performance of the drill pipe. At present, the drill pipe mainly uses corrosion inhibitors to prevent corrosion, and wear-resistant belts of the drill pipe are only arranged at joints on two sides of the drill pipe. However, due to a complex downhole environment, changes in temperature and pH values, etc. may all affect the performance of the corrosion inhibitors, and the use of the corrosion inhibitors has the disadvantages of an unstable effect and high cost, etc. In the actual drilling process, a middle part of the drill pipe may also rub against a shaft wall, making a surface of the drill pipe exposed to a corrosive medium to accelerate a corrosion process, posing a threat to the safety of personnel and equipment.

Aluminum alloy sacrificial anodes are widely used in major oilfields because of the advantages thereof of high driving potential, large capacitance, high current efficiency and good stability. However, general aluminum alloys are easy to passivate, and a trend of passivation is more obvious with the increase of temperature. At present, the aluminum alloy sacrificial anodes used in down-hole strings are mainly made by mold casting. However, sacrificial anode materials manufactured by casting have internal thermal stress, cracks easily occur to reduce the bonding force between sacrificial anode and matrix. In addition, the sacrificial anode materials are prone to bubbles during a solidification process, resulting in an uneven surface of the sacrificial anode, and incomplete contact with the surface of the string matrix leads to a decrease in the protective effect.

SUMMARY

In view of this, an object of the present disclosure is to overcome the shortcomings of the prior art. An anti-corrosion wear-resistant drill pipe and a preparation method thereof are provided through technological innovation, solving the defects of easy corrosion of a drill pipe in a harsh environment, an unstable anti-corrosion effect of a corrosion inhibitor, high costs and others, and the problem that the middle part of the drill pipe has friction with a shaft wall due to the absence of wear-resistant belts.

In order to solve the technical problems, the technical solutions of the present disclosure are as follows.

A first technical object of the present disclosure is to provide the anti-corrosion wear-resistant drill pipe, and the anti-corrosion wear-resistant drill pipe includes a drill pipe main body, sacrificial anodes and the wear-resistant belts, where the sacrificial anodes include a first sacrificial anode, a second sacrificial anode, a third sacrificial anode and a fourth sacrificial anode, the first sacrificial anode, the second sacrificial anode, the third sacrificial anode and the fourth sacrificial anode are identical in chemical compositions, physical properties, size structure and functional characteristics, and the first sacrificial anode, the second sacrificial anode, the third sacrificial anode and the fourth sacrificial anode include chemical compositions in the following proportions: 94-97 wt % of aluminum, 2.5-5 wt % of zinc, 0.05-0.3 wt % of indium, 0.02-0.2 wt % of silicon, 0.06-0.12 wt % of tin, 0.05-0.4 wt % of titanium, and 0.02-0.12 wt % of iron;

the wear-resistant belts include a first wear-resistant belt, a second wear-resistant belt and a third wear-resistant belt, where the first wear-resistant belt, the second wear-resistant belt and the third wear-resistant belt are identical in chemical compositions, physical properties, size structure and functional characteristics, and the first wear-resistant belt, the second wear-resistant belt and the third wear-resistant belt include chemical compositions in the following proportions: 86-90 wt % of iron, 6-15 wt % of chromium, 1-3 wt % of nickel, 0.5-0.8 wt % of carbon, 0.15-1.2 wt % of silicon, 0.9-1.6 wt % of manganese, 0.5-1.3 wt % of molybdenum, 0.1-0.5 wt % of boron, and 0.05-0.2 wt % of titanium; and geometrical relationships of the drill pipe main body, the first wear-resistant belt, the second wear-resistant belt, the third wear-resistant belt, the first sacrificial anode, the second sacrificial anode, the third sacrificial anode and the fourth sacrificial anode are as follows: the second wear-resistant belt is positioned in a center of the drill pipe, the second sacrificial anode and the third sacrificial anode are mirror symmetric with respect to a circular section B at a distance of h/2, the first wear-resistant belt and the third wear-resistant belt are mirror symmetric with respect to the circular section B at a distance of L+h/2, the first sacrificial anode and the fourth sacrificial anode are mirror symmetric with respect to the circular section B at a distance of L+3h/2, and the first wear-resistant belt, the second wear-resistant belt, the third wear-resistant belt and a drill pipe matrix are in transition connection by two identical 90° rounded corners.

Optionally, the first sacrificial anode, the second sacrificial anode, the third sacrificial anode and the fourth sacrificial anode have a length L of 0.5-1 m, and a thickness $\zeta$ of 1-1.5 mm; and the first wear-resistant belt, the second wear-resistant belt and the third wear-resistant belt have a length h of 25-50 mm, a thickness $\delta$ of 2-3 mm, and a rounded corner radius R0 of 1-1.5 mm.

Further, the relationships of the thickness $\zeta$ of the first sacrificial anode, the second sacrificial anode, the third sacrificial anode and the fourth sacrificial anode, the thickness $\delta$ of the first wear-resistant belt, the second wear-resistant belt and the third wear-resistant belt, an outer radius R1 of the drill pipe, an outer radius R2 of the sacrificial anodes and an outer radius R3 of the wear-resistant belts are: $\zeta=R2-R1$, $\delta=R3-R1$, and $\delta=2\zeta=2R0$.

A second technical object of the present disclosure is to provide a preparation method of the anti-corrosion wear-resistant drill pipe as described above, including the following steps:

step 1: providing one finished drill pipe and cleaning a surface of the drill pipe;

step 2: putting, into a vacuum ball mill, iron powder, chromium powder, nickel powder, carbon powder, silicon powder, manganese powder, molybdenum powder, boron powder and titanium powder in proportion and ball milling for 24 h to obtain a wear-resistant belt powder, and putting, into a vacuum ball mill, aluminum powder, zinc powder, indium powder, silicon powder, tin powder, titanium powder and iron powder in proportion and ball milling for 24 h to obtain a sacrificial anode powder;

step 3: preheating the drill pipe cleaned in step 1 at a preheating temperature of 50-250° C.;

step 4: loading the wear-resistant belt powder obtained in step 2 into a powder feeder of laser cladding equipment, and setting process parameters for the equipment;

step 5: cladding the wear-resistant belt powder at set positions on a surface of a drill pipe matrix by using a synchronous laser cladding process, to form a first wear-resistant belt, a second wear-resistant belt and a third wear-resistant belt, then pausing the laser cladding equipment, and polishing surfaces of the wear-resistant belts to make thicknesses of wear-resistant belt parts of the drill pipe uniform and consistent; and step 6: replacing the wear-resistant belt powder in the powder feeder in the laser cladding equipment with the sacrificial anode powder, starting the laser cladding equipment to clad the sacrificial anode powder on set positions on the surface of the drill pipe matrix to form a first sacrificial anode, a second sacrificial anode, a third sacrificial anode and a fourth sacrificial anode, then closing the laser cladding equipment, and polishing surfaces of sacrificial anodes to make thicknesses of sacrificial anode parts of the drill pipe uniform and consistent.

Optionally, a mass ratio of the iron powder, the chromium powder, the nickel powder, the carbon powder, the silicon powder, the manganese powder, the molybdenum powder, the boron powder and the titanium powder in step 2 is (86-90):(6-15):(1-3):(0.5-0.8):(0.15-1.2):(0.9-1.6):(0.5-1.3):(0.1-0.5):(0.05-0.2).

Optionally, a mass ratio of the aluminum powder, the zinc powder, the indium powder, the silicon powder, the tin powder, the titanium powder and the iron powder in step 2 is (94-97):(2.5-5):(0.05-0.3):(0.02-0.2):(0.06-0.12):(0.05-0.4):(0.02-0.12).

Further, the wear-resistant belt powder in step 2 has a particle size of 2-60 μm, and a sphericity of 0.8-0.95; and the sacrificial anode powder has a particle size of 5-150 μm, and a sphericity of 0.8-0.95.

Further, parameters of the laser cladding process are as follows: a laser power of 1.3-2.5 kW, a powder feeding speed of 8-20 g/min, a light spot diameter of 0.1-2 mm, a scanning line speed of 90-300 mm/min, a rotating speed of the drill pipe matrix of 2-6 rpm, and a protective gas of argon gas.

Further, the first wear-resistant belt, the second wear-resistant belt and the third wear-resistant belt each have a surface hardness greater than 750 $HV_{0.1}$.

Further, the first sacrificial anode, the second sacrificial anode, the third sacrificial anode and the fourth sacrificial anode have an open-circuit potential of −1.31 to −1.10 V, an operating potential of −1.21 to −0.98V, and a current efficiency of greater than 80%, in a drilling fluid corrosive environment with a density of 1.2-2.5 g/cm$^3$, a chloride ion content of 1,200-180,000 mg/L, and a temperature of 30-120° C.

Compared with the prior art, the advantages of the present disclosure are as follows.

1. In the present disclosure, zinc and indium elements in aluminum alloy sacrificial anode materials can produce a synergistic effect to improve the adsorption capacity of chloride ions on surfaces of materials, thus playing an activation role; the tin element can enhance the activation performance of materials, cause a negative shift in electric potential, and effectively prevent the passivation phenomenon of the materials at high temperatures; the iron element can effectively inhibit galvanic coupling corrosion of anode materials; and the titanium and silicon elements can achieve alloying of aluminum alloy materials, thereby keeping the anode materials active and simultaneously effectively prolonging the anode materials' service life.

2. In the present disclosure, the carbon element in wear-resistant belt materials can generate a carbon (boron) compound with high hardness, with chromium element and boron element, thereby improving the hardness of the materials; the nickel and manganese elements can improve the toughness of the materials, so that the wear-resistant belts are not easy to break under a high pressure; and the titanium, molybdenum and silicon elements can enhance the hardness and wear resistance of wear-resistant belt materials.

3. In the present disclosure, the aluminum alloy sacrificial anodes and the wear-resistant belts are alternately arranged side by side, and positioned as a whole in a center of the drill pipe, and the thickness of the wear-resistant belts is greater than the thickness of the sacrificial anodes. This structural design not only avoids the friction loss caused by a direct contact between the drill pipe and the shaft wall, but also prevents the friction between the sacrificial anodes and the shaft wall. A rounded transition design is adopted at a joint between the wear-resistant belts and the drill pipe matrix, effectively dispersing the stress concentration and improving an overall structural strength and durability of the drill pipe. The overall design enhances the wear resistance and anti-corrosion performance of the drill pipe, and the long-term stability of the drilling operation can be effectively ensured.

4. In the present disclosure, the sacrificial anodes and the wear-resistant belts are all cladded on the drill pipe matrix by the synchronous laser cladding process, which, compared with a casting process, requires no mold, enables stronger bonding force with the surface of the drill pipe matrix, and effectively reduces the risk of material shedding.

BRIEF DESCRIPTION OF DRAWINGS

In order to more clearly illustrate the embodiments of the present disclosure or the technical solutions in the prior art, the drawings required for describing the embodiments or the prior art are briefly described below. Obviously, the drawings in the following description are only the embodiments of the present disclosure, and for those of ordinary skill in the art, other drawings may also be obtained in accordance with the provided drawings without paying creative efforts.

DETAILED DESCRIPTION OF EMBODIMENTS

The technical solutions in the embodiments of the present disclosure are clearly and completely described below. It is obvious that the described embodiments are only some of the embodiments of the present disclosure, rather than all embodiments. Based on the embodiments in the present disclosure, all other embodiments obtained by those of ordinary skill in the art without making creative efforts are included in the scope of protection of the present disclosure.

A term "embodiment" is used exclusively herein, and any embodiment described as "exemplary" need not be construed as superior or better than other embodiments. Unless otherwise specified, the performance index tests in the embodiments of the present application adopt conventional test methods in the art. It is to be understood that the terms described in the present application are only for describing specific embodiments, and are not used to limit the contents disclosed in the present application.

Unless otherwise specified, technical and scientific terms used herein have the same meaning as commonly understood by those of ordinary skill in the art to which the present application belongs. Other test methods and technical means not specifically specified in the present application refer to the test methods and technical means commonly used by those of ordinary skill in the prior art.

In the description of the present disclosure, it is to be understood that orientation or position relationships indicated by the terms "middle", "up", "down", "rise", "fall", "vertical", "surface", "top", "bottom", "inner", "outer", and so on are the orientation or position relationship shown based on the drawings, which is only for ease of describing the present disclosure and simplifying the description, rather than indicating or implying that the device or element referred to has to be in a specific orientation, constructed and operated in a particular orientation, and therefore cannot be constructed as a limitation on the present disclosure.

In order to better explain the contents of the present application, numerous specific details are given in the following specific embodiments. It is to be understood by those skilled in the art that the present application may be implemented without certain specific details. In the embodiments, some methods, means, instruments and equipment familiar to those skilled in the art are not described in detail in order to highlight the main purpose of the present application.

On the premise of no conflict, the technical features disclosed in the embodiments of the present application can be combined arbitrarily, and the obtained technical solutions belong to the contents disclosed in the embodiments of the present application.

Figure 1:
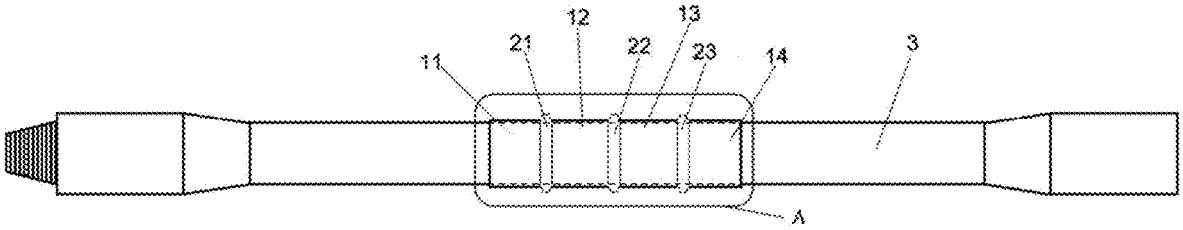
FIG. 1 is an overall structural diagram of an anti-corrosion wear-resistant drill pipe in the present disclosure.
Figure 2:
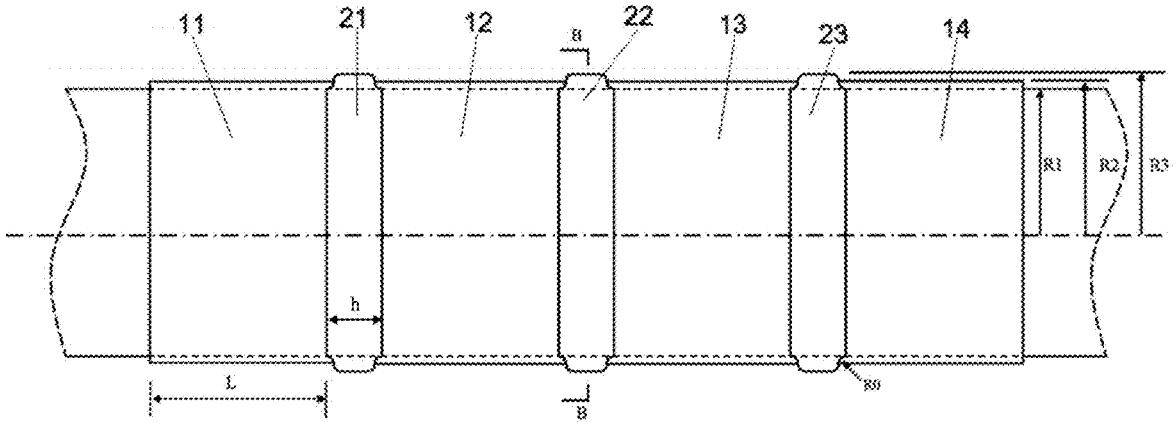
FIG. 2 is an enlarged diagram of part A in the present disclosure.
Figure 3:
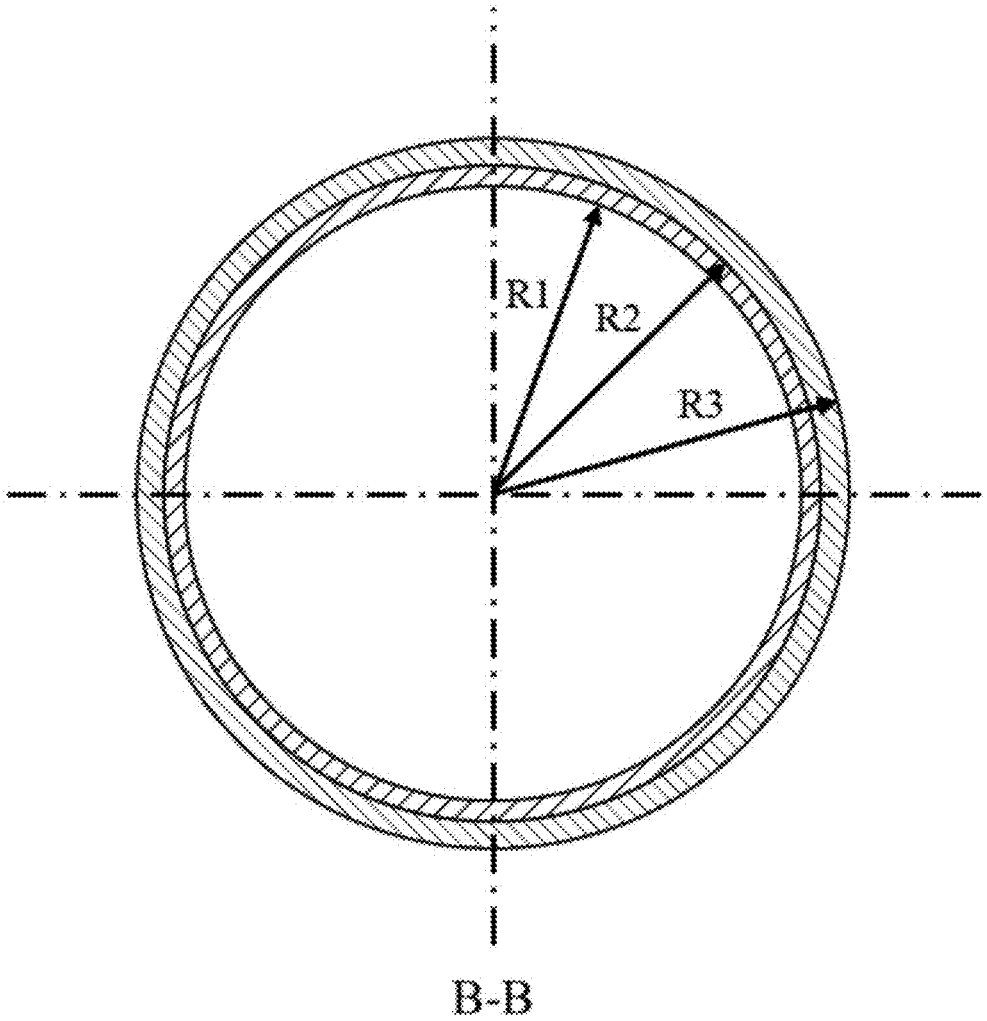
FIG. 3 is a sectional diagram of part B in the present disclosure.

Referring to FIG. 1-FIG. 3, the present disclosure discloses an anti-corrosion wear-resistant drill pipe, and the anti-corrosion wear-resistant drill pipe includes a drill pipe main body 3, sacrificial anodes and wear-resistant belts.

The sacrificial anodes include a first sacrificial anode 11, a second sacrificial anode 12, a third sacrificial anode 13 and a fourth sacrificial anode 14, and the wear-resistant belts include a first wear-resistant belt 21, a second wear-resistant belt 22 and a third wear-resistant belt 23. Geometrical relationships of the drill pipe main body 3, the first wear-resistant belt 21, the second wear-resistant belt 22, the third wear-resistant belt 23, the first sacrificial anode 11, the second sacrificial anode 12, the third sacrificial anode 13 and the fourth sacrificial anode 14 are as follows: the second wear-resistant belt 22 is positioned in a center of a drill pipe, the second sacrificial anode 12 and the third sacrificial anode 13 are mirror symmetric with respect to a circular section B at a distance of h/2, the first wear-resistant belt 21 and the third wear-resistant belt 23 are mirror symmetric with respect to the circular section B at a distance of L+h/2, the first sacrificial anode 11 and the fourth sacrificial anode 14 are mirror symmetric with respect to the circular section B at a distance of L+3h/2, and the first wear-resistant belt 21, the second wear-resistant belt 22, the third wear-resistant belt 23 and a drill pipe matrix are in transition connection by two identical 90° rounded corners.

Further, the first sacrificial anode 11, the second sacrificial anode 12, the third sacrificial anode 13 and the fourth sacrificial anode 14 have a length of 0.5-1 m, and a thickness $\zeta$ of 1-1.5 mm, and has an open-circuit potential of −1.31 to −1.10 V and a current efficiency of greater than 80% in a drilling fluid corrosive environment with a density of 1.2-2.5 g/cm$^3$, a chloride ion content of 1,200-180,000 mg/L and a temperature of 30-120° C. The first wear-resistant belt 21, the second wear-resistant belt 22 and the third wear-resistant belt 23 have a length h of 25-50 mm, a thickness $\delta$ of 2-3 mm, a rounded corner radius R0 of 1-1.5 mm, and a surface hardness greater than 750 $HV_{0.1}$. The relationships of the thickness & of the first sacrificial anode 11, the second sacrificial anode 12, the third sacrificial anode 13 and the fourth sacrificial anode 14, the thickness $\delta$ of the first wear-resistant belt 21, the second wear-resistant belt 22 and the third wear-resistant belt 23, the outer radius R1 of the drill pipe, the outer radius R2 of the sacrificial anodes and the outer radius R3 of the wear-resistant belts are as follows: $\zeta$=R2−R1, $\delta$=R3−R1, and $\delta$=2$\zeta$=2R0.

In order to better understand the present disclosure, the following embodiments are used to further elaborate on the present disclosure, but it cannot be understood as a limitation of the present disclosure. Some non-essential improvements and adjustments made by those skilled in the art according to the above summary are also regarded as falling within the protection scope of the present disclosure.

EXAMPLE 1

A preparation method of an anti-corrosion wear-resistant drill pipe included the following steps.

Step 1: one finished drill pipe was provided, and the surface of the drill pipe was cleaned;

step 2: iron powder, chromium powder, nickel powder, carbon powder, silicon powder, manganese powder, molybdenum powder, boron powder and titanium powder were put into a vacuum ball mill in proportion and ball milled for 24 h to obtain a wear-resistant belt powder, and aluminum powder, zinc powder, indium powder, silicon powder, tin powder, titanium powder and iron powder were put into a vacuum ball mill in proportion and ball milled for 24 h to obtain a sacrificial anode powder;

step 3: the cleaned drill pipe was preheated at a preheating temperature of 150° C.;

step 4: the wear-resistant belt powder was loaded into a powder feeder of laser cladding equipment, and process parameters were set for the equipment;

step 5: the wear-resistant belt powder was cladded at set positions on a surface of the drill pipe matrix by using a synchronous laser cladding process, to form a first wear-resistant belt 21, a second wear-resistant belt 22 and a third wear-resistant belt 23, then the laser cladding equipment was paused, and surfaces of the wear-resistant belts were polished to make thicknesses of wear-resistant belt parts of the drill pipe uniform and consistent; and step 6: the wear-resistant belt powder in the powder feeder in the laser cladding equipment was replaced with the sacrificial anode powder, the laser cladding equipment was started to clad the sacrificial anode powder on set positions on the surface of the drill pipe matrix to form a first sacrificial anode 11, a second sacrificial anode 12, a third sacrificial anode 13 and a fourth sacrificial anode 14, then the laser cladding equipment was closed, and surfaces of sacrificial anodes are polished to make thicknesses of sacrificial anode parts of the drill pipe uniform and consistent.

Preferably, a mass ratio of the iron powder, the chromium powder, the nickel powder, the carbon powder, the silicon powder, the manganese powder, the molybdenum powder, the boron powder and the titanium powder was 86:10:1:0.5:0.5:1.2:0.5:0.1:0.2.

Preferably, a mass ratio of the aluminum powder, the zinc powder, the indium powder, the silicon powder, the tin powder, the titanium powder and the iron powder was 94:5:0.3:0.1:0.12:0.4:0.08.

Further, the wear-resistant belt powder had a particle size of 15-45 μm, and a sphericity of 0.87-0.92; and the sacrificial anode powder had a particle size of 5-45 μm, and a sphericity of 0.88-0.95.

Further, parameters of the above laser cladding process were as follows: a laser power of 2.2 kW, a powder feeding speed of 15 g/min, a light spot diameter of 0.6 mm, a scanning line speed of 100 mm/min, a rotating speed of the drill pipe matrix of 2 rpm, and a protective gas of argon gas.

Further, the first sacrificial anode 11, the second sacrificial anode 12, the third sacrificial anode 13 and the fourth sacrificial anode 14 prepared above had a length L of 0.5 m, and a thickness ζ of 1 mm; and the first wear-resistant belt 21, the second wear-resistant belt 22 and the third wear-resistant belt 23 had a length h of 25 mm, a thickness δ of 2 mm, and a rounded corner radius R0 of 1 mm.

EXAMPLE 2

A preparation method of an anti-corrosion wear-resistant drill pipe included the following steps.

Step 1: one finished drill pipe was provided, and the surface of the drill pipe was cleaned;

step 2: iron powder, chromium powder, nickel powder, carbon powder, silicon powder, manganese powder, molybdenum powder, boron powder and titanium powder were put into a vacuum ball mill in proportion and ball milled for 24 h to obtain a wear-resistant belt powder, and aluminum powder, zinc powder, indium powder, silicon powder, tin powder, titanium powder and iron powder were put into a vacuum ball mill in proportion and ball milled for 24 h to obtain a sacrificial anode powder;

step 3: the cleaned drill pipe was preheated at a preheating temperature of 150° C.;

step 4: the wear-resistant belt powder was loaded into a powder feeder of laser cladding equipment, and process parameters were set for the equipment;

step 5: the wear-resistant belt powder was cladded at set positions on a surface of the drill pipe matrix by using a synchronous laser cladding process, to form a first wear-resistant belt 21, a second wear-resistant belt 22 and a third wear-resistant belt 23, then the laser cladding equipment was paused, and surfaces of the wear-resistant belts were polished to make thicknesses of wear-resistant belt parts of the drill pipe uniform and consistent; and step 6: the wear-resistant belt powder in the powder feeder in the laser cladding equipment was replaced with the sacrificial anode powder, the laser cladding equipment was started to clad the sacrificial anode powder on set positions on the surface of the drill pipe matrix to form a first sacrificial anode 11, a second sacrificial anode 12, a third sacrificial anode 13 and a fourth sacrificial anode 14, then the laser cladding equipment was closed, and surfaces of sacrificial anodes are polished to make thicknesses of sacrificial anode parts of the drill pipe uniform and consistent.

Preferably, a mass ratio of the iron powder, the chromium powder, the nickel powder, the carbon powder, the silicon powder, the manganese powder, the molybdenum powder, the boron powder and the titanium powder was 88:6:2:0.5:1:0.9:1:0.4:0.2.

Preferably, a mass ratio of the aluminum powder, the zinc powder, the indium powder, the silicon powder, the tin powder, the titanium powder and the iron powder was 95:4:0.3:0.1:0.08:0.4:0.12.

Further, the wear-resistant belt powder had a particle size of 2-20 μm, and a sphericity of 0.90-0.95; and the sacrificial anode powder had a particle size of 20-55 μm, and a sphericity of 0.85-0.92.

Further, parameters of the above laser cladding process were as follows: a laser power of 2.5 kW, a powder feeding speed of 15 g/min, a light spot diameter of 0.5 mm, a scanning line speed of 120 mm/min, a rotating speed of the drill pipe matrix of 3 rpm, and a protective gas of argon gas.

Further, the first sacrificial anode 11, the second sacrificial anode 12, the third sacrificial anode 13 and the fourth sacrificial anode 14 prepared above had a length L of 0.6 m, and a thickness ζ of 1.1 mm; and the first wear-resistant belt 21, the second wear-resistant belt 22 and the third wear-resistant belt 23 had a length h of 30 mm, a thickness δ of 2.2 mm, and a rounded corner radius R0 of 1.1 mm.

EXAMPLE 3

A preparation method of an anti-corrosion wear-resistant drill pipe included the following steps.

Step 1: one finished drill pipe was provided, and the surface of the drill pipe was cleaned;

step 2: iron powder, chromium powder, nickel powder, carbon powder, silicon powder, manganese powder, molybdenum powder, boron powder and titanium powder were put into a vacuum ball mill in proportion and ball milled for 24 h to obtain a wear-resistant belt powder, and aluminum powder, zinc powder, indium powder, silicon powder, tin powder, titanium powder and iron powder were put into a vacuum ball mill in proportion and ball milled for 24 h to obtain a sacrificial anode powder;

step 3: the cleaned drill pipe was preheated at a preheating temperature of 150° C.;

step 4: the wear-resistant belt powder was loaded into a powder feeder of laser cladding equipment, and process parameters were set for the equipment;

step 5: the wear-resistant belt powder was cladded at set positions on a surface of the drill pipe matrix by using a synchronous laser cladding process, to form a first wear-resistant belt 21, a second wear-resistant belt 22 and a third wear-resistant belt 23, then the laser cladding equipment was paused, and surfaces of the wear-resistant belts were polished to make thicknesses of wear-resistant belt parts of the drill pipe uniform and consistent; and step 6: the wear-resistant belt powder in the powder feeder in the laser cladding equipment was replaced with the sacrificial anode powder, the laser cladding equipment was started to clad the sacrificial anode powder on set positions on the surface of the drill pipe matrix to form a first sacrificial anode 11, a second sacrificial anode 12, a third sacrificial anode 13 and a fourth sacrificial anode 14, then the laser cladding equipment was closed, and surfaces of sacrificial anodes are polished to make thicknesses of sacrificial anode parts of the drill pipe uniform and consistent.

Preferably, a mass ratio of the iron powder, the chromium powder, the nickel powder, the carbon powder, the silicon powder, the manganese powder, the molybdenum powder, the boron powder and the titanium powder was 90:6:1:0.5:0.2:1.2:0.6:0.4:0.1.

Preferably, a mass ratio of the aluminum powder, the zinc powder, the indium powder, the silicon powder, the tin powder, the titanium powder and the iron powder was 96:3.2:0.16:0.2:0.12:0.2:0.12.

Further, the wear-resistant belt powder had a particle size of 20-60 μm, and a sphericity of 0.8-0.85; and the sacrificial anode powder had a particle size of 30-100 μm, and a sphericity of 0.82-0.87.

Further, parameters the above laser cladding process are as follows: a laser power of 1.5 kW, a powder feeding speed of 12 g/min, a light spot diameter of 1.8 mm, a scanning line speed of 150 mm/min, a rotating speed of the drill pipe matrix of 4 rpm, and a protective gas of argon gas.

Further, the first sacrificial anode 11, the second sacrificial anode 12, the third sacrificial anode 13 and the fourth sacrificial anode 14 prepared above had a length L of 0.8 m, and a thickness ζ of 1.2 mm; and the first wear-resistant belt 21, the second wear-resistant belt 22 and the third wear-resistant belt 23 had a length h of 35 mm, a thicknesses δ of 2.4 mm, and a rounded corner radius R0 of 1.2 mm.

EXAMPLE 4

A preparation method of an anti-corrosion wear-resistant drill pipe included the following steps.

Step 1: one finished drill pipe was provided, and the surface of the drill pipe was cleaned;

step 2: iron powder, chromium powder, nickel powder, carbon powder, silicon powder, manganese powder, molybdenum powder, boron powder and titanium powder were put into a vacuum ball mill in proportion and ball milled for 24 h to obtain a wear-resistant belt powder, and aluminum powder, zinc powder, indium powder, silicon powder, tin powder, titanium powder and iron powder were put into a vacuum ball mill in proportion and ball milled for 24 h to obtain a sacrificial anode powder;

step 3: the cleaned drill pipe was preheated at a preheating temperature of 150° C.;

step 4: the wear-resistant belt powder was loaded into a powder feeder of laser cladding equipment, and process parameters were set for the equipment;

step 5: the wear-resistant belt powder was cladded at set positions on a surface of the drill pipe matrix by using a synchronous laser cladding process, to form a first wear-resistant belt 21, a second wear-resistant belt 22 and a third wear-resistant belt 23, then the laser cladding equipment was paused, and surfaces of the wear-resistant belts were polished to make thicknesses of wear-resistant belt parts of the drill pipe uniform and consistent; and step 6: the wear-resistant belt powder in the powder feeder in the laser cladding equipment was replaced with the sacrificial anode powder, the laser cladding equipment was started to clad the sacrificial anode powder on set positions on the surface of the drill pipe matrix to form a first sacrificial anode 11, a second sacrificial anode 12, a third sacrificial anode 13 and a fourth sacrificial anode 14, then the laser cladding equipment was closed, and surfaces of sacrificial anodes are polished to make thicknesses of sacrificial anode parts of the drill pipe uniform and consistent.

Preferably, a mass ratio of the iron powder, the chromium powder, the nickel powder, the carbon powder, the silicon powder, the manganese powder, the molybdenum powder, the boron powder and the titanium powder was 90:6:1:0.8:0.2:0.9:0.6:0.4:0.1.

Preferably, a mass ratio of the aluminum powder, the zinc powder, the indium powder, the silicon powder, the tin powder, the titanium powder and the iron powder was 96:3.5:0.1:0.02:0.1:0.2:0.08.

Further, the wear-resistant belt powder had a particle size of 15-55 μm, and a sphericity of 0.84-0.89; and the sacrificial anode powder had a particle size of 80-150 μm, and a sphericity of 0.8-0.85.

Further, parameters of the above laser cladding process were as follows: a laser power of 1.8 kW, a powder feeding speed of 10 g/min, a light spot diameter of 1.5 mm, a scanning line speed of 200 mm/min, a rotating speed of the drill pipe matrix of 5 rpm, and a protective gas of argon gas.

Further, the first sacrificial anode 11, the second sacrificial anode 12, the third sacrificial anode 13 and the fourth sacrificial anode 14 prepared above had a length L of 1 m, and a thickness ζ of 1.5 mm; and the first wear-resistant belt 21, the second wear-resistant belt 22 and the third wear-resistant belt 23 had a length h of 50 mm, a thickness δ of 3 mm, and a rounded corner radius R0 of 1.5 mm.

In order to further prove the beneficial effects of the present disclosure and better understand the present disclosure, the following conventional index data are used to further clarify the technical features disclosed in the present disclosure. However, it cannot be understood as a limitation on the present disclosure. Other improvements made by those skilled in the art based on the above summary without creative work are also regarded as falling within the protection scope of the present disclosure.

The sacrificial anodes of Examples 1-4 were subjected to an electrochemical test in a drilling fluid corrosion environment with a density of 2.35 g/cm$^3$, a chloride ion content of 63,000 mg/L, and a temperature of 30-120° C. The test results are shown in Table 1.

Table 1 Results of measured operating potentials and calculated current efficiencies of sacrificial anodes of Examples 1-4 of the present disclosure in the drilling fluid corrosive environment with the density of 2.35 g/cm$^3$, the chloride ion content of 63,000 mg/L, and the temperature of 30-120° C.

| Test Item | Temperature/ ° C. | Operating potential (SCE)/V | Current efficiency/% |
|---|---|---|---|
| Example 1 | 30 | −1.19 | 88.94 |
| | 60 | −1.14 | 86.42 |
| | 90 | −1.10 | 83.22 |
| | 120 | −1.08 | 81.23 |
| Example 2 | 30 | −1.18 | 88.35 |
| | 60 | −1.12 | 86.09 |
| | 90 | −1.09 | 83.17 |
| | 120 | −1.06 | 81.08 |
| Example 3 | 30 | −1.16 | 88.01 |
| | 60 | −1.10 | 85.86 |
| | 90 | −1.08 | 83.18 |
| | 120 | −1.05 | 81.09 |
| | 30 | −1.15 | 87.98 |
| Example 4 | 60 | −1.09 | 85.43 |
| | 90 | −1.06 | 83.06 |
| | 120 | −1.01 | 80.62 |

As can be seen from Table 1, the anti-corrosion wear-resistant drill pipe is prepared by the method provided by the present disclosure, the sacrificial anodes on the drill pipe have the operating potential (SCE) in the range of −1.21 to −0.98V and the current efficiency of greater than 80% in the drilling fluid corrosive environment with the density of 2.35 g/cm$^3$, and the chloride ion content of 63,000 mg/L and the temperature of 30-120° C. The operating potential is stable, the current efficiency is high, and the cathodic protection potential requirements of various alloy steel drill pipes can be met.

The wear-resistant belts of Examples 1-4 were tested for micro-hardness, where Vickers hardness was tested by using a digital microhardness tester under the conditions of a load of 0.1 kgf and an action time of 5 s. The test results are shown in Table 2.

The wear-resistant belts of Examples 1-4 were tested for friction tests, where wear amount was tested by using a friction and wear testing machine under the conditions of a load of 10 N, a frequency of 5 Hz, an amplitude of 2 mm and a duration of 30 min. The test results are shown in Table 2.

Table 2 Test Results of Hardness and Wear Amounts of Wear-Resistant Belts Examples 1~4 of the present disclosure

| Test Item | Average hardness/$HV_{0.1}$ | Wear amount/mg |
|---|---|---|
| Example 1 | 880 | 2.3 |
| Example 2 | 900 | 1.9 |
| Example 3 | 790 | 5.6 |
| Example 4 | 850 | 3.2 |

As can be seen from Table 1, for the anti-corrosion wear-resistant drill pipe prepared by the preparation method of an anti-corrosion wear-resistant drill pipe provided by the present disclosure, the average hardness of the wear-resistant belts on the drill pipe exceeds 750 $HV_{0.1}$, and the hardness of a drill pipe body is in the range of 350-450 $HV_{0.1}$, and the hardness of the wear-resistant belts prepared is about 2 times that of the drill pipe body, which can meet the anti-wear requirements of the drill pipe.

The foregoing description of the disclosed embodiments enables those skilled in the art to achieve or use the present disclosure. A plurality of modifications to these embodiments are obvious to those skilled in the art, and the general principles defined herein may be achieved in other embodiments without departing from the spirit or scope of the present disclosure. Therefore, the present disclosure is not to be limited to the embodiments shown herein, but is to be conformed to the widest scope consistent with the principles and novel features disclosed herein.

What is claimed is:

1. An anti-corrosion wear-resistant drill pipe, wherein the anti-corrosion wear-resistant drill pipe comprises a drill pipe main body, sacrificial anodes and wear-resistant belts, wherein the sacrificial anodes comprise a first sacrificial anode, a second sacrificial anode, a third sacrificial anode and a fourth sacrificial anode, the first sacrificial anode, the second sacrificial anode, the third sacrificial anode and the fourth sacrificial anode are identical in chemical compositions, physical properties, size structure and functional characteristics, and the first sacrificial anode, the second sacrificial anode, the third sacrificial anode and the fourth sacrificial anode comprise the chemical compositions in following proportions: 94-97 wt % of aluminum, 2.5-5 wt % of zinc, 0.05-0.3 wt % of indium, 0.02-0.2 wt % of silicon, 0.06-0.12 wt % of tin, 0.05-0.4 wt % of titanium, and 0.02-0.12 wt % of iron;

the wear-resistant belts comprise a first wear-resistant belt, a second wear-resistant belt and a third wear-resistant belt, the first wear-resistant belt, the second wear-resistant belt and the third wear-resistant belt are identical in chemical compositions, physical properties, size structure and functional characteristics, and the first wear-resistant belt, the second wear-resistant belt and the third wear-resistant belt comprise chemical compositions in following proportions: 86-90 wt % of iron, 6-15 wt % of chromium, 1-3 wt % of nickel, 0.5-0.8 wt % of carbon, 0.15-1.2 wt % of silicon, 0.9-1.6 wt % of manganese, 0.5-1.3 wt % of molybdenum, 0.1-0.5 wt % of boron, and 0.05-0.2 wt % of titanium;

geometrical relationships of the drill pipe main body, the first wear-resistant belt, the second wear-resistant belt, the third wear-resistant belt, the first sacrificial anode, the second sacrificial anode, the third sacrificial anode and the fourth sacrificial anode are as follows: the second wear-resistant belt is positioned in a center of a drill pipe, the second sacrificial anode and the third sacrificial anode are mirror symmetric with respect to a circular section B at a distance of h/2, the first wear-resistant belt and the third wear-resistant belt are mirror symmetric with respect to the circular section B at a distance of L+h/2, the first sacrificial anode and the fourth sacrificial anode are mirror symmetric with respect to the circular section B at a distance of L+3h/2, the first wear-resistant belt, the second wear-resistant belt, the third wear-resistant belt and a drill pipe matrix are in transition connection by two identical 90° rounded corners, and the circular section B is a tangent plane perpendicular to an axial direction at the center of the drill pipe; and L is a length of each of the first sacrificial anode, the second sacrificial anode, the third sacrificial anode and the fourth sacrificial anode, h is a length of each of the first wear-resistant belt, the second wear-resistant belt and the third wear-resistant belt, and L and h are lengths parallel to the axial direction of the drill pipe.

2. The anti-corrosion wear-resistant drill pipe according to claim 1, wherein the first sacrificial anode, the second sacrificial anode, the third sacrificial anode and the fourth sacrificial anode have the length L of 0.5-1 m, and a thickness ζ of 1-1.5 mm, and the first wear-resistant belt, the second wear-resistant belt and the third wear-resistant belt have the length h of 25-50 mm, a thickness δ of 2-3 mm, and a rounded corner radius R0 of 1-1.5 mm; and relationships of the thickness ζ of the first sacrificial anode, the second sacrificial anode, the third sacrificial anode and the fourth sacrificial anode, the thickness δ of the first wear-resistant belt, the second wear-resistant belt and the third wear-resistant belt, an outer radius R1 of the drill pipe, an outer radius R2 of the sacrificial anodes and an outer radius R3 of the wear-resistant belts are: ζ=R2−R1, and δ=R3−R1.

3. The anti-corrosion wear-resistant drill pipe according to claim 2, wherein relationships of the thickness ζ, the thickness δ and the rounded corner radius R0 are: ζ=R2−R1, δ=R3−R1, and δ=2ζ=2R0.

4. The anti-corrosion wear-resistant drill pipe according to claim 1, wherein relationships of the thickness ζ, the thickness δ and the rounded corner radius R0 are: ζ=R2−R1, δ=R3−R1, and δ=2ζ=2R0.

5. A preparation method of the anti-corrosion wear-resistant drill pipe according to claim 1, comprising following steps:

step 1: providing one finished drill pipe and cleaning a surface of the drill pipe;

step 2: ball milling iron powder, chromium powder, nickel powder, carbon powder, silicon powder, manganese powder, molybdenum powder, boron powder and titanium powder in proportion to obtain a wear-resistant belt powder, and ball milling aluminum powder, zinc powder, indium powder, silicon powder, tin powder, titanium powder and iron powder in proportion to obtain a sacrificial anode powder;

step 3: preheating the drill pipe cleaned in the step 1 at a preheating temperature of 50-250° C.;

step 4: loading the wear-resistant belt powder obtained in the step 2 into a powder feeder of laser cladding equipment, setting process parameters for the equipment, cladding the wear-resistant belt powder at set positions on a surface of a drill pipe matrix by using a synchronous laser cladding process, to form a first wear-resistant belt, a second wear-resistant belt and a third wear-resistant belt, then pausing the laser cladding equipment, and polishing surfaces of the wear-resistant belts to make thicknesses of wear-resistant belt parts of the drill pipe uniform and consistent; and step 5: replacing the wear-resistant belt powder in the powder feeder in the laser cladding equipment with the sacrificial anode powder, starting the laser cladding equipment to clad the sacrificial anode powder on set positions on the surface of the drill pipe matrix to form a first sacrificial anode, a second sacrificial anode, a third sacrificial anode and a fourth sacrificial anode, then closing the laser cladding equipment, and polishing surfaces of the sacrificial anodes to make thicknesses of sacrificial anode parts of the drill pipe uniform and consistent.

6. The preparation method of the anti-corrosion wear-resistant drill pipe according to claim 5, wherein a mass ratio of the iron powder, the chromium powder, the nickel powder, the carbon powder, the silicon powder, the manganese powder, the molybdenum powder, the boron powder and the titanium powder in the step 2 is (86-90):(6-15):(1-3):(0.5-0.8):(0.15-1.2):(0.9-1.6):(0.5-1.3):(0.1-0.5):(0.05-0.2).

7. The preparation method of the anti-corrosion wear-resistant drill pipe according to claim 5, wherein a mass ratio of the aluminum powder, the zinc powder, the indium powder, the silicon powder, the tin powder, the titanium powder and the iron powder in the step 2 is (94-97):(2.5-5):(0.05-0.3):(0.02-0.2):(0.06-0.12):(0.05-0.4):(0.02-0.12).

8. The preparation method of the anti-corrosion wear-resistant drill pipe according to claim 5, wherein the wear-resistant belt powder in the step 2 has a particle size of 2-60 μm, and a sphericity of 0.8-0.95; and the sacrificial anode powder has a particle size of 5-150 μm, and a sphericity of 0.8-0.95.

9. The preparation method of the anti-corrosion wear-resistant drill pipe according to claim 5, wherein parameters of the synchronous laser cladding process comprise: a laser power of 1.3-2.5 kW, a powder feeding speed of 8-20 g/min, a light spot diameter of 0.1-2 mm, a scanning line speed of 90-300 mm/min, a rotating speed of the drill pipe matrix of 2-6 rpm, and a protective gas of argon gas.

10. The preparation method of the anti-corrosion wear-resistant drill pipe according to claim 5, wherein the first wear-resistant belt, the second wear-resistant belt and the third wear-resistant belt each have a surface hardness greater than 750 $HV_{0.1}$.

11. The preparation method of the anti-corrosion wear-resistant drill pipe according to claim 5, wherein the first sacrificial anode, the second sacrificial anode, the third sacrificial anode and the fourth sacrificial anode have an open-circuit potential of −1.31 to −1.10 V, an operating potential of −1.21 to −0.98V and a current efficiency of greater than 80% in a drilling fluid corrosive environment with a density of 1.2-2.5 g/cm$^3$, a chloride ion content of 1,200-180,000 mg/L and a temperature of 30-120° C.

12. The preparation method of the anti-corrosion wear-resistant drill pipe according to claim 5, wherein the first sacrificial anode, the second sacrificial anode, the third sacrificial anode and the fourth sacrificial anode have the length L of 0.5-1 m, and a thickness ζ of 1-1.5 mm, and the first wear-resistant belt, the second wear-resistant belt and the third wear-resistant belt have the length h of 25-50 mm, a thickness δ of 2-3 mm, and a rounded corner radius R0 of 1-1.5 mm; and relationships of the thickness ζ of the first sacrificial anode, the second sacrificial anode, the third sacrificial anode and the fourth sacrificial anode, the thickness δ of the first wear-resistant belt, the second wear-resistant belt and the third wear-resistant belt, an outer radius R1 of the drill pipe, an outer radius R2 of the sacrificial anodes and an outer radius R3 of the wear-resistant belts are: ζ=R2−R1, and δ=R3−R1.

13. The preparation method of the anti-corrosion wear-resistant drill pipe according to claim 5, wherein relationships of the thickness ζ, the thickness δ and the rounded corner radius R0 are: ζ=R2−R1, δ=R3−R1, and δ=2ζ=2R0.

* * * * *